US006371823B1

(12) United States Patent
Stavran

(10) Patent No.: US 6,371,823 B1
(45) Date of Patent: Apr. 16, 2002

(54) WRAPPING MEANS FOR CONVERTING A FOOD ARTICLE CARTON OR BOX INTO A TOY DEVICE

(76) Inventor: Ola Stavran, Romsdalsveien 15B, N-6300 Andalsnes (NO)

( * ) Notice: Subject to any disclaimer, the term of this patent is extended or adjusted under 35 U.S.C. 154(b) by 0 days.

(21) Appl. No.: 09/242,141

(22) PCT Filed: Aug. 4, 1997

(86) PCT No.: PCT/NO97/00197

§ 371 Date: May 28, 1999

§ 102(e) Date: May 28, 1999

(87) PCT Pub. No.: WO98/05572

PCT Pub. Date: Feb. 12, 1998

(30) Foreign Application Priority Data

May 8, 1996 (NO) ..... 963270

(51) Int. Cl.[7] ..... A63H 33/08
(52) U.S. Cl. ..... 446/128; 446/85
(58) Field of Search ..... 446/71, 85, 128

(56) References Cited

U.S. PATENT DOCUMENTS 1,237,728 A * 8/1917 Tuck
D252,977 S * 9/1979 Bayly
4,254,574 A * 3/1981 Stock
4,602,908 A * 7/1986 Kroeber ..... 446/128
D301,260 S * 5/1989 McLaughlin et al.
4,844,263 A * 7/1989 Hadtke ..... 206/508
5,125,867 A * 6/1992 Solomon ..... 446/488
D371,281 S * 7/1996 Credle, Jr. ..... D7/625
5,662,508 A * 9/1997 Smith ..... 446/128
5,676,251 A * 10/1997 Credle, Jr. ..... 206/501

* cited by examiner

*Primary Examiner*—John A. Ricci
(74) *Attorney, Agent, or Firm*—Cowan, Liebowitz & Latman, P.C.; Michael I. Wolfson

(57) ABSTRACT

A wrapping band for converting cut standard food cartons into a toy building block, which in the form of a continuous band comprises five surface elements. Each surface element is hinged to the adjacent element or elements along a line or lines, perpendicular to the longitudinal direction of the band. The surface elements are connected as follows: a first end element having a closure slot for engagement with a closure tongue; a top element having a plurality of circular projections or pegs; a second end element; a bottom element having a plurality of holes corresponding to the number of pegs in the top element; and generally arrow-shaped locking tongue for engagement with the slot. The toy building block is formed when the band is secured about the carton.

12 Claims, 3 Drawing Sheets

WRAPPING MEANS FOR CONVERTING A FOOD ARTICLE CARTON OR BOX INTO A TOY DEVICE

BACKGROUND OF THE INVENTION

The present invention relates to a wrapping band for converting cut, standard food cartons into a toy.

There are a large number of packaging cartons currently available on the market for the packaging of food products such as milk, cream, juice and preserves.

In general these cartons may be divided into two main types, namely cartons of the "elopak" type and cartons of the "tetrapak" type.

The present invention is described for cartons of the "elopak" type, in particular, but it does not exceed the scope of the invention to apply it to cartons of other types.

The "elopak" cartons are characterized by a square base surface and a height which varies according to the quantity of food to be packaged, the main sizes being 1/1 liter, ½ liter, ⅓ liter and ¼ liter.

These cartons are found in large quantities on the market and are essentially disposed of as household waste material, while to only a very small degree being subjected to any form of reuse.

In general this represents a waste of resources, and an objective of the present invention is to make some contribution toward alleviating this waste by proposing a possible form of reuse.

The intention of the present invention is to provide an article by means of which a used carton of the type introduced above, cut or trimmed in a simple manner, may be converted into a toy.

Of the known art in this area, reference is made to NO 132,335, which describes a unit composed of elements which are provided with snap-like connecting means, for the formation of toys, teaching aids, window displays, and furnishing and decorating items.

Reference is also made to DE 39.20.886-A1, which shows containers of various shapes which, after use, may be used as toy building blocks.

SUMMARY OF THE INVENTION

With reference to the above, the present invention relates to a wrapping band for converting cut, standard food cartons into a toy, and this band is characterized in that it comprises, in the form of a continuous band, five surface elements, each hinged to the adjacent element or elements along a line or lines perpendicular to the longitudinal direction of the band, as follows:

a) a first end element having a closure slot for engagement with a closure tongue;

b) a top element having a plurality of circular projections, or pegs, for engagement with the holes of another toy;

c) a second end element (4);

d) an bottom element having holes for engagement with the pegs on another toy; and e) a generally arrow-shaped locking tongue for engagement with the slot mentioned under letter a).

With the aid of the wrapping band of the invention, a carton cut to standard measurements may be converted into a toy of the "lego®" type.

BRIEF DESCRIPTION OF THE DRAWINGS

The invention will be described in more detail with reference to the accompanying drawings where.

DESCRIPTION OF THE PREFERRED EMBODIMENTS

Figure 1:
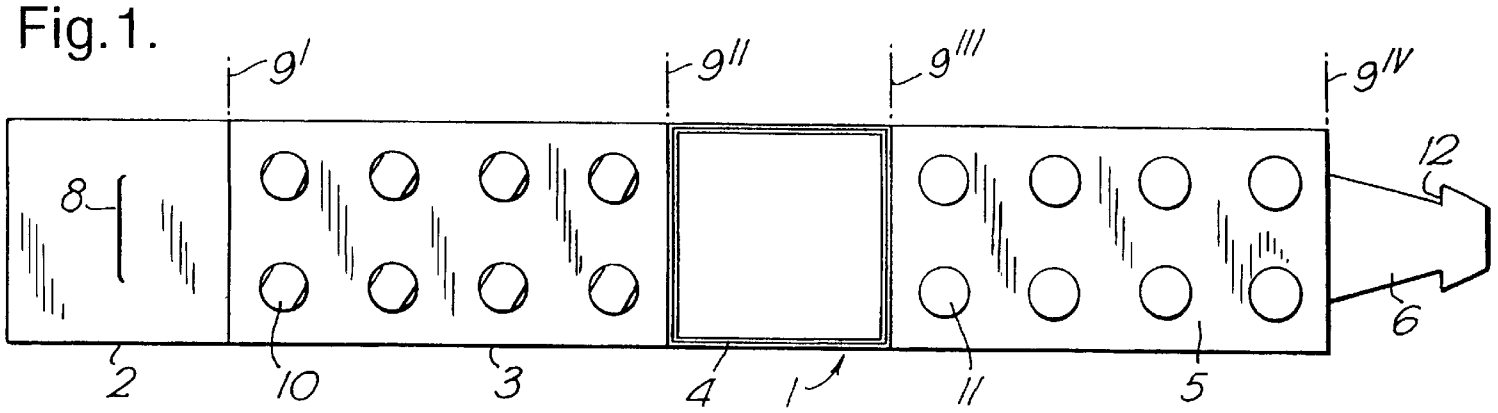
FIG. 1 is a top view of the band in accordance with the invention.
Figure 2:
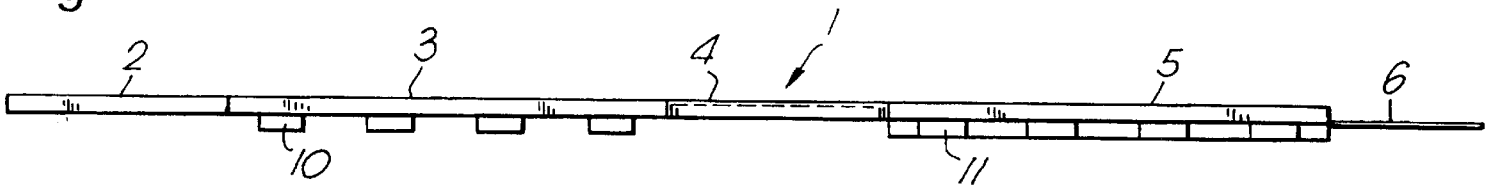
FIG. 2 is a side view of the same band.

The band (1), as mentioned in the introduction, comprises five surface elements.

a) The first surface element is an end element (2), adapted to cover preferably the bottom, but optionally also the open end formed by cutting of, a carton (7).

Where cartons of the "elopak" type are concerned, this surface element is square, but it may, of course, be given any shape at all depending on the type of carton that one chooses to work with.

The end element (2) is provided with a slot (8) for engagement with the tongue (6) described below when the band in the invention is locked around a carton (7).

b) The surface element (2) is hinged to a top element (3) along a fold line ($9^{I}$).

The surface element (3) is provided with a plurality of pegs (10) which, as will be shown below, are adapted for engagement with corresponding holes (11) in a bottom element on another toy.

These pegs are arranged in rows and lines, where the axes of the rows and lines are perpendicular to each other and where the distance to center for the pegs is constant.

For cartons of the "elopak" type it is practical to have two rows, but the number of pegs in each row depends on the size to which the carton is cut.

Here we can envision a large block having 8 pegs in two rows and an embodiment form that is half as large, this being with a square arrangement with a peg in each corner.

c) This top element (3) is hinged to an end element (4) along the fold line ($9^{II}$).

This element (4) may have the form of an open frame if the objective is to make a building block having a cavity inside, for example to represent a garage for toy cars.

The frame may be filled in, however, in such manner as to make a closed building block.

It does not exceed the scope of the invention if the closure of the frame for element (4) is removable or has the form of a door, for example, capable of being folded along a fold line in the longitudinal direction of the wrapping band.

d) The end element (4) is, in turn, foldably hinged to the underside element (5) along the line ($9^{III}$).

The element (5) is provided with a plurality of holes (11), arranged opposite pegs (10) in the surface element (3).

j) These holes are intended for receival of the pegs (10) on another toy and therefore have an inside diameter which sufficiently larger than the outer diameter of the pegs (10) as to enable the latter to be easily pushed into the holes and also easily withdrawn again.

It is conceivable here to provide for a form of stabilization lock, for example with the aid of beads and corresponding grooves in the holes and on the pegs, respectively.

e) Finally, the surface element (5) is hinged to a tongue (6) along the fold line ($9^{IV}$).

The tongue has the general form of an optionally truncated arrow provided with catches (12). This arrow is adapted for engagement with the slot (8) in the surface element (2).

Figure 3:
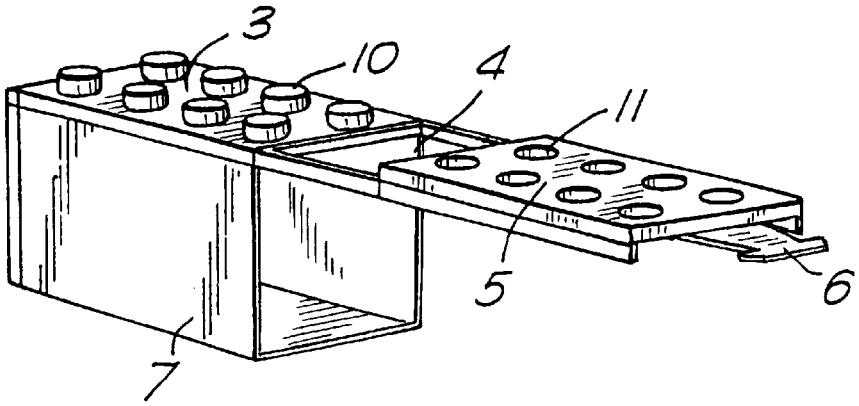
FIG. 3 shows the band where two surface elements are positioned on a cut carton.

In FIG. 3 is shown a carton (7) where the end element (2) and the top element (3) are put into position.

In this case, the carton is indicated as being open, and if the element (4) is also open as suggested above, it is possible to produce an open block, as shown in FIG. (4).

Figure 4:
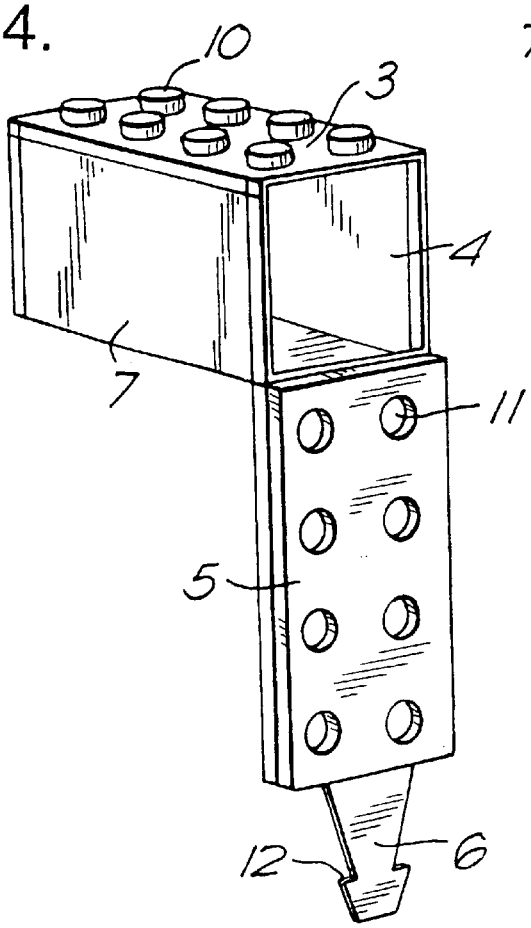
FIG. 4 shows the same band where still another end element is positioned on the carton.

FIG. 4 also illustrates the situation before the bottom element is folded up under the carton.

Figure 5:
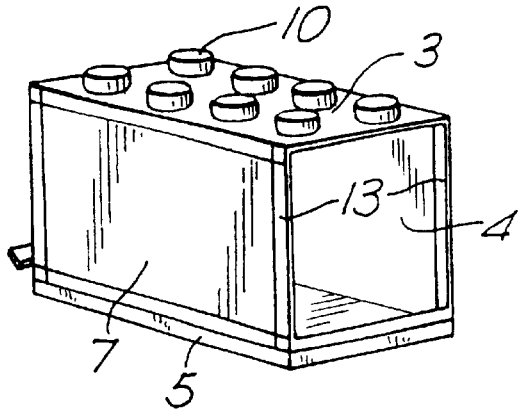
FIG. 5 shows the finished toy.

FIG. 5 shows the finished block, where the element (5) is folded up under the carton, and (not shown) the tongue (6) is inserted into the slot (8) for locking engagement with the aid of the catches (12).

Figure 6:
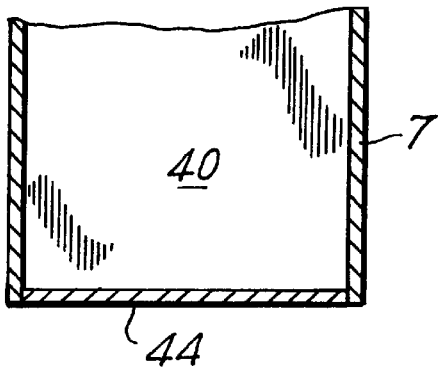
FIG. 6 shows the finished toy of FIG. 5 in cross-section with an open frame having a plate in place for closing the lock.

FIG. 6 shows the finished block as in FIG. 5 in cross-section with an open end 40 having a plate 44 attached to end 40 for closing the opening.

Figure 7:
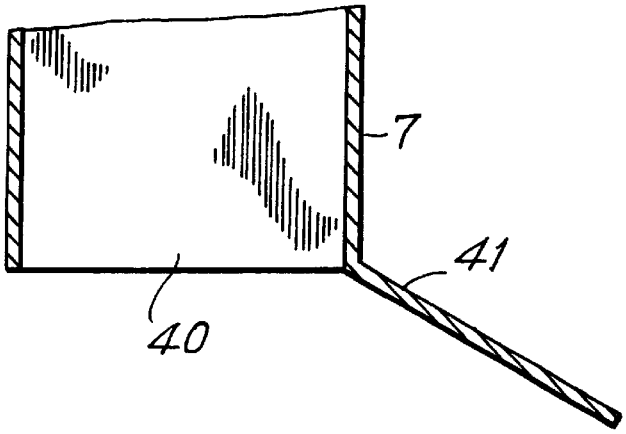
FIG. 7 shows the finished toy as in FIG. 6 with the open frame having a single plate for closing the opening.

FIG. 7 shows the finished block as in FIG. 5 having open end 40 and including a single hinged plate 41 for closing the opening.

Figure 8:
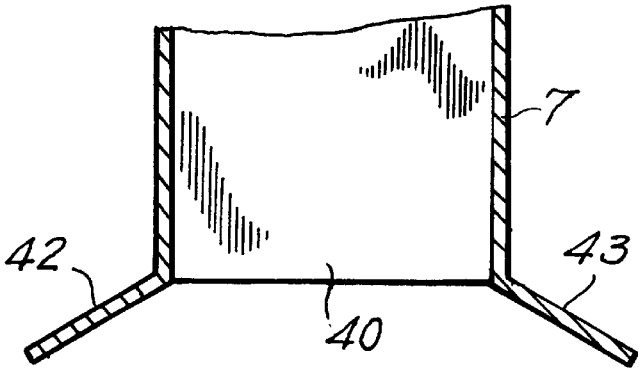
FIG. 8 shows the finished toy as in FIG. 6 with the open end having two hinged plate for closing the opening.

FIG. 8 shows the finished block as in FIGS. 5, 6, 7 having end 40 including two hinged plates 42 and 43 for closing the opening.

Figure 9:
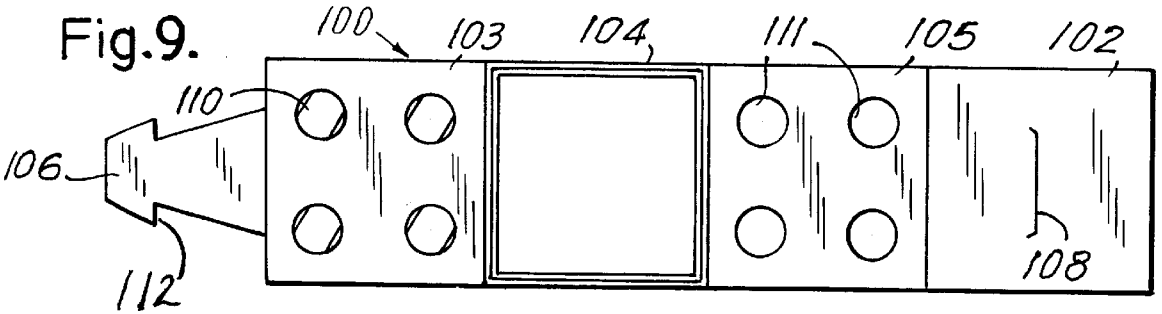
FIG. 9 is a top view of a further embodiment of a band in accordance with the invention.

FIG. 9 shows an embodiment wherein a band 100 includes a first end element 106 in the form of a tongue with catches 112, a top or bottom element 103 having four pegs 110, a second end element 104 in the form of an open frame, a bottom or top element 105 having four holes 111 corresponding to pegs 110 in element 103 and a second end element 112 with a slot 108 for coupling with tongue 106.

The block which is obtained with the aid of the subject of this invention is relatively large and is excellently suited for smaller children.

The bands (1) according to the invention can be produced from any suitable plastic material whatsoever, preferably return plastic, provided that existing regulations are complied with as regards safety and health.

The bands may be marketed in stacks, together with an appurtenant pattern for cutting the cartons to the desired size; and the cartons are nevertheless to be found in large quantities in nearly every household, particularly in households where there are children who can use the toys produced therefrom.

What is claimed is:

1. A wrapping band for converting cut, standard food cartons (7) into a toy, comprising a continuous band (1) formed with five surface elements (2,3,4,5,6) each hinged to the adjacent element or elements along a line or lines perpendicular to the longitudinal direction of the band (1), the surface elements along the longitudinal direction being a) a first end element having closure slot (8) or a closure tongue (6) for engagement;

b) a first top or bottom element (3 or 5) hinged to the first end element and having a plurality of circular pegs (10) or a plurality of holes (11);

c) a second end element (4) hinged to the first top or bottom element (3 or 5);

d) a second bottom or top element (5 or 3) hinged to the second end element (4) and having a plurality of holes (11) or pegs (10), the number of hole or pegs in the top or bottom element corresponding to the number of pegs or holes in the opposed top or bottom element (3 or 5);

e) a fifth surface element having a locking tongue (6) or closure slot (8) hinged to the top or bottom element (3 or 5) for locking engagement with the slot (8) or tongue (6) in the first end element;

f) the second end element being an open frame; and g) a removable plate for closing the open frame in the second end element.

2. The band in accordance with claim 1, wherein the tongue (6) is provided with catches (12) for locking engagement with the slot (8).

3. The band in accordance with claim 1, wherein that the pegs (10) and the holes (11) are arranged in pairs and in rows, perpendicular to and parallel with the longitudinal direction of the band (1).

4. The band in accordance with claim 1, wherein the top element (3 or 5) and the bottom element (5 or 3) have eight pegs (10) and holes (11) respectively.

5. The band in accordance with claim 1, wherein the distance between centers for the pegs (10) and the holes (11), respectively, is constant in the longitudinal and the transverse direction of the band (1).

6. The band in accordance with claim 1, including one plate for closing the open frame of second end element (4), with the one plate foldably hinged along one edge (13) of the second element (4).

7. The band in accordance with claim 1, wherein the top element (3 or 5) and the bottom element (5 or 3) have four pegs (10) and cooperating holes (11) respectively.

8. The band in accordance with claim 1, including two hinged plates for closing the open frame, the two plates foldably hinged along both of the opposed edges (13) of the second end element (4).

9. A wrapping band for converting cut, standard food cartons into a toy, comprising a continuous band formed with five surface elements, each element hinged to the adjacent element or elements along a line or lines perpendicular to the longitudinal direction of the band, the surface elements along the longitudinal direction being a) a first end element having closure slot or a locking tongue for engagement;

b) a first connecting means bearing element hinged to the first end element and having a plurality of connecting means, c) a second end element hinged to the first connecting means element;

d) a second connecting means element hinged to the second end element and having a plurality of connecting means for connecting with the connecting means on the opposed connecting means element when assembled, each element corresponding to the number of connecting means in the opposed connecting means element; and e) a fifth surface element having a locking tongue or closure slot hinged on adjacent connecting means element, the tongue or slot for locking engagement with the first end element;

f) the second end element being an open frame; and g) a removable plate for closing the open frame in the open end element.

10. The band in accordance with claim 9, including one plate for closing the open frame of second end element, with the one plate foldably hinged along one edge of the second end element.

11. The band in accordance with claim 9, wherein the connecting element each have four pegs or holes each, respectively.

12. The band in accordance with claim 9, including two hinged plates for closing the open frame with the two plates, foldably hinged along both of the opposed edges of the open end element.

* * * * *